United States Patent [19]

Van der Westhuizen et al.

[11] Patent Number: 4,829,900

[45] Date of Patent: May 16, 1989

[54] MAT FOR USE WITH ROCK BREAKING TOOL

[75] Inventors: Hermanus Q. Van der Westhuizen, Pretoria; Thomas M. Muller, Boksburg, both of South Africa

[73] Assignee: Boutade Worldwide Investments NV, Netherlands

[21] Appl. No.: 55,427

[22] Filed: May 28, 1987

[30] Foreign Application Priority Data

Sep. 15, 1986 [ZA] South Africa ..... 86/6991

[51] Int. Cl.[4] ..... F42D 3/04; F42D 5/00

[52] U.S. Cl. ..... 102/303; 299/13

[58] Field of Search ..... 299/13, 16, 20; 166/299; 102/301, 303, 304, 313, 316; 175/1

[56] References Cited

U.S. PATENT DOCUMENTS 1,247,567 11/1917 O'Brien ..... 102/313

2,558,924 7/1951 Blake ..... 102/301 X 2,926,605 3/1960 Hammel et al. ..... 102/303

4,148,375 4/1979 Dowler et al. ..... 102/301 X 4,449,754 5/1984 Orlov et al. ..... 102/304 X

FOREIGN PATENT DOCUMENTS 203598 10/1967 U.S.S.R. ..... 102/303

*Primary Examiner*—Jerome W. Massie

*Assistant Examiner*—David J. Bagnell

*Attorney, Agent, or Firm*—Darby & Darby

[57] ABSTRACT

The invention relates to a rock breaking tool having a barrel insertable into a pre-drilled, water-filled hole of the rock. The rock breaking tool utilizes a firing chamber to discharge a cartridge into the barrel. A blast absorbing mat is located over the tool to retain the tool in position in the hole during discharge. The invention also relates to the method of using the rock breaking tool.

6 Claims, 2 Drawing Sheets

MAT FOR USE WITH ROCK BREAKING TOOL

INTRODUCTION TO THE INVENTION

This invention relates to a barrel for use in a rock breaking tool, and a method of using such a tool.

BACKGROUND TO THE INVENTION

This type of rock breaking tool utilises a firing chamber to discharge a cartridge into the barrel. The tool is used by inserting the barrel into a pre-drilled holding rock which is filled with water prior to firing. On discharging the tool into the hole, the expansion of gases from the firing causes water pressure in the form of a shock wave, which splits and cracks up the rock.

Rock breaking tools of this type known to the applicant have an extended barrel which is located in the length of the pre-drilled hole, with the tip of the barrel having a radially expandable seal. This seal expands by reason of lateral openings in the barrel directing discharge gases against the inner radial surface of the seal, and the expanding seal grips the surrounding rock to hold the tool within the hole sufficiently long for the discharge shock to break up the rocks. Without such a device for holding the tool within the hole, the tool is inclined to shoot out under blow back forces and the energy intended for breaking up the rock, is to a large extent lost.

The barrel of this type of tool has lateral discharge outlets along its length to allow lateral impulsive discharge forces to operate on the rock surrounding the hole. The tip, itself apart from the lateral discharge outlets for expanding the seal, is closed off.

The above rock breaking tool and method of using it also requires that a fairly long hole be drilled to accommodate the length of the barrel and the lateral discharge outlet. This hole must also be fairly accurately dimensioned and not be of too wide a diameter, since this can also serve to disperse and waste the energy shock. The hole must also be relatively water-tight and the longer the hole that is drilled, the greater is the chance of a leakage.

OBJECT OF THE INVENTION

It is the object of this invention to provide an alternative barrel for use with a rock breaking tool, and a method of breaking rock with it that will at least alleviate the abovementioned difficulties.

SUMMARY OF THE INVENTION

In accordance with this invention there is provided a method of breaking up rock including drilling a hole in the rock, substantially filling the hole with water, and inserting a barrel of a rock breaking tool into the hole, the tool being operable to discharge a cartridge from a firing chamber down the barrel, and, discharging the cartridge down the barrel to cause an impulsive energy shock in the water to break up the rock. The barrel used is short so as to be inserted in the entrance portion only of the hole, and a blast absorbing mat is located over the tool to retain it substantially in position in the hole during discharge.

A feature of the method provides for a rock breaking tool to be is used which has its barrel exterior tapered towards the discharge end and for the barrel to be secured in the hole with the hole periphery in contact around the firing chamber end of the barrel.

Further the mat may be provided with a central opening with reinforced periphery, and is placed to have the firing chamber end of the tool protruding through the mat hole, leaving the hole periphery resting on transverse handles provided on the tool.

In accordance with a different aspect of the invention, there is provided a barrel adapted for use in a rock breaking tool, which tool is operable by insertion of its barrel into a water filled pre-drilled hole in rock to be broken up, and discharge of a cartridge down the barrel into the hole, said barrel comprising a tubular barrel member being connectible at one end to a firing chamber, and extending a short distance from this firing chamber end to the opposite discharge end where substantially the sole discharge outlet is located, the barrel length allowing it to be inserted only part way into the water filled rock hole in use.

An important feature of the invention provides for the barrel exterior to taper down towards the discharge end by an amount arranged to facilitate insertion of the barrel in a hole drilled in rock by standard drill bit size, and to leave the firing chamber end of the barrel in contact with the periphery of the hole in operative location.

The invention extends to a rock breaking tool fitted with a barrel as above defined, and to rock breaking apparatus comprising such a rock breaking tool and a blast absorbing mat locatable over the rock breaking tool in use and arranged to prevent the tool being blown back out of a hole during discharge of the tool.

The invention also includes a mat having a central opening with reinforced periphery adapted for locating over a rock breaking tool with transverse handles, with the tool protruding partly through the hole and the periphery of the mat resting on the handles, and the reinforcing being adapted to prevent the periphery of the mat opening from expanding on discharge of the tool, and so allowing the tool to blow back through the central opening.

Preferably the mat reinforcing is wire, and the mat is woven of strip rubber-dash type vehicle tire material, being approximately 2,3m$^2$ in area. The mat may be square and measure 1,5 m$\times$1,5 m, and be approximately 15 mm thick.

BRIEF DESCRIPTION OF THE DRAWINGS

A preferred embodiment of the invention is described below by way of example only, and with reference to the accompanying drawings, in which.

DETAILED DESCRIPTION OF THE DRAWINGS

Figure 1:
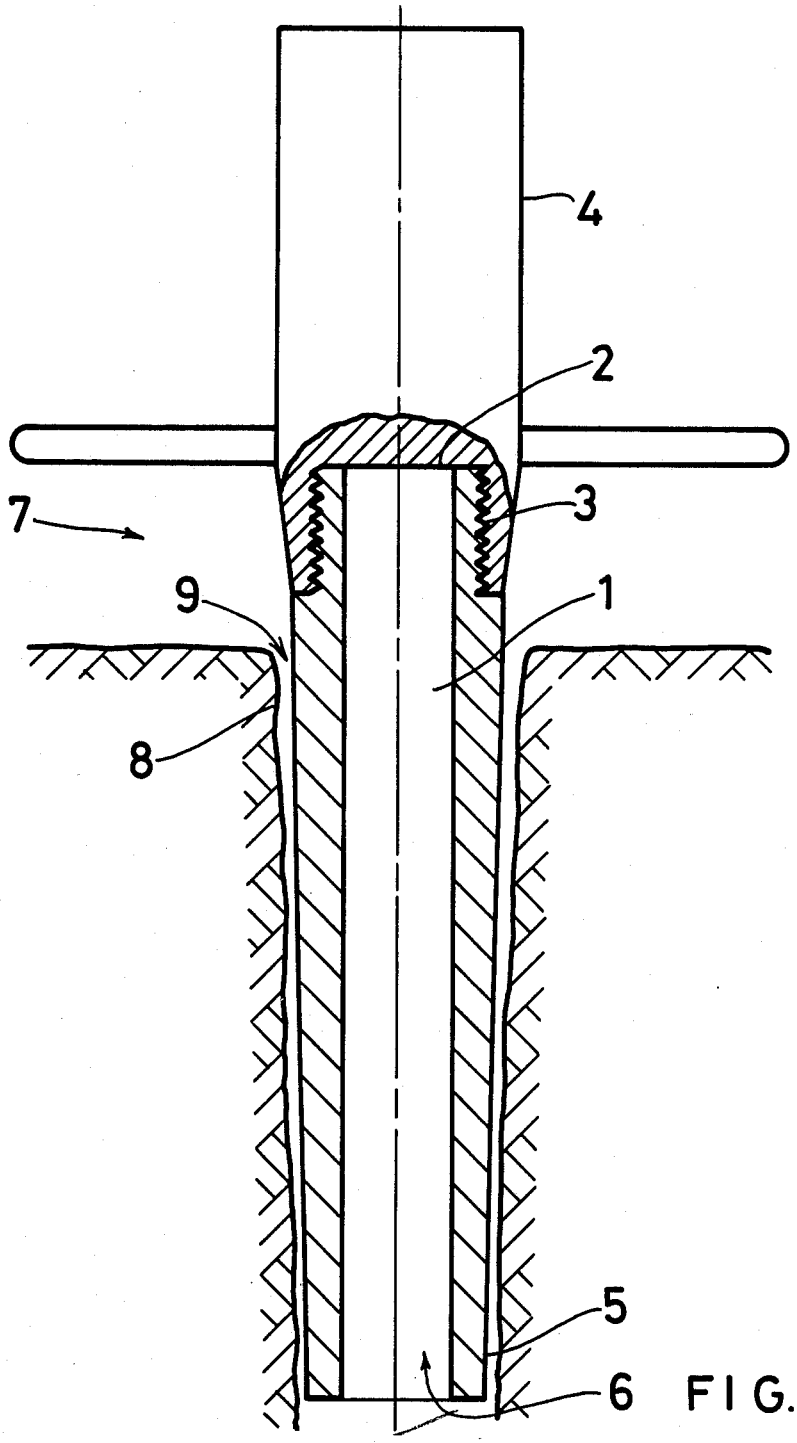
FIG. 1 is a cross-section through a barrel according to the invention located in a rock hole; and, FIG. 2 is an isometric illustrative view of a blasting mat according to the invention.

Referring to FIG. 1, a barrel (1) for a rock breaking tool is tubular, having an end (2) which is diametrically rebated and threaded at (3) in order to be screw-fitted to a firing chamber (4). The opposite discharge end (5) of the barrel carries the sole discharge outlet (6) of the barrel opening which runs axially through the barrel. The barrel exterior is tapered down smoothly from the firing chamber end (2) to the discharge end (5).

In use, the barrel, operatively connected to a firing chamber (4) to form a tool (7), is inserted in a pre-drilled rock hole (8), which is filled with water. The hole (8) is drilled to a diameter which will allow the barrel (1) to close off the entrance (9) of the hole when the barrel is inserted, and preferably this closing off will occur when the barrel rests in the hole with the periphery of the hole entrance at the firing chamber end of the barrel. The majority of the length of the barrel should thus be inserted in the hole.

The taper of the barrel is arranged to allow easy but relatively close fitting insertion of the inserted barrel length in a hole having a diameter within tolerances to be expected from drilling with a standard size drill bit.

It has been found in practice that a taper from an outside diameter of 38 mm to 34 mm end to end over a barrel shaft length of 140 mm is suitable for a 36 mm drill bit drilling a 38 mm hole.

Since the barrel has no gripping mechanism, an additional restraining means is provided, to prevent a tool fitted with the barrel from blowing back out of the hole on discharge.

Figure 2:
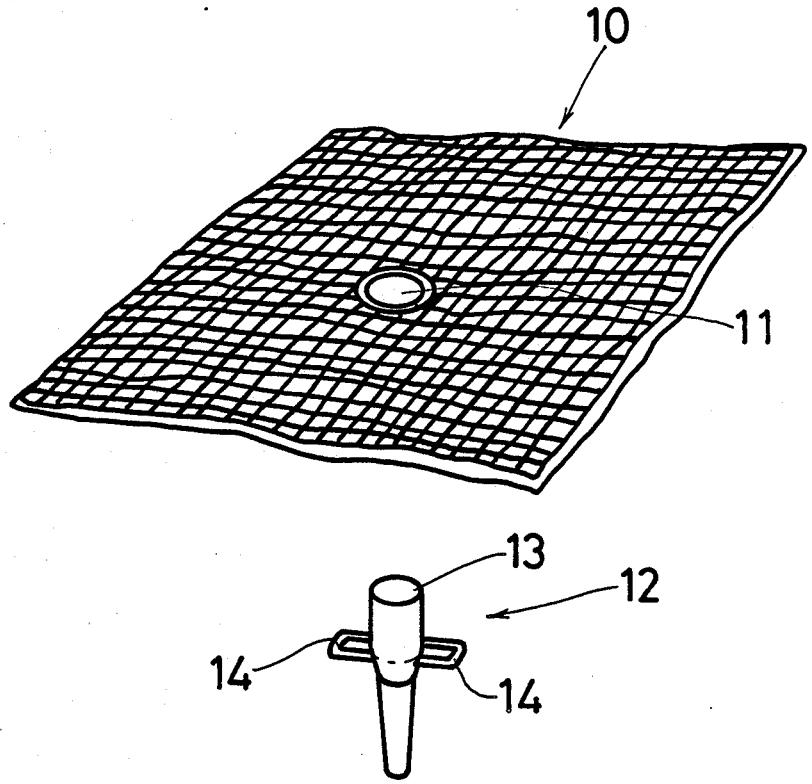

Referring now to FIG. 2, a mat (10) is shown which is of square configuration, having sides of approximately 1.5×1.5 metres in length. The mat is of woven rubber tire strip material, and of approximately 15 millimetres thickness. It has a central opening (11) which is round and has wire reinforcing around it to restrict its expandability.

In use, the mat is located over a rock breaking tool (12), with the upper firing chamber portion (13) of the tool protruding through the hole and the periphery of the hole resting on transverse handles (14) of the tool. It has been found in practice that the mat serves to contain the blow back forces to good effect.

Variations may be made to the above embodiment without departing from the scope of the invention. For example, the extent of taper on the barrel will depend on the size of the tool and the hole which is to be drilled, and the dimensions and shape of the mat may vary widely. The may also be round, but this is not a convenient shape for folding and carrying.

What is claimed is:

1. A mat for use with a rock breaking tool having a barrel, support means for retaining the mat around the tool, and a combustion chamber extending upwardly from said support means, said mat including a central opening with a reinforced periphery adapted to be located over said rock breaking tool, with said combustion chamber protruding partly through the opening and the mat resting on the support means, the reinforced periphery being adapted to prevent the central opening from expanding on discharge of the tool, and so allowing the tool to blow back through the central opening.

2. A mat as claimed in claim 1 in which the reinforced periphery of the opening includes wire.

3. A mat as claimed in any one of claims 1 or 2 in which the mat is woven of strips of vehicle tire material.

4. A mat as claimed in claim 1 in which the mat is approximately 2.3 square meters in area.

5. A mat as claimed in claim 1 in which the mat is square and measures approximately 1.5 meters on each side.

6. A mat as claimed in claim 1 in which the mat is approximately 15 mm thick.

* * * * *